United States Patent [19]

Chang

[11] 4,195,103

[45] Mar. 25, 1980

[54] METHOD OF DESENSITIZING CARBONLESS PAPER

[75] Inventor: John C. H. Chang, Naperville, Ill.

[73] Assignee: Wallace Business Forms, Inc., Hillside, Ill.

[21] Appl. No.: 937,956

[22] Filed: Aug. 30, 1978

[51] Int. Cl.[2] ..... B05C 5/00; B05C 17/04

[52] U.S. Cl. ..... 427/54.1; 106/21; 204/159.16; 204/159.23; 204/159.24; 282/27.5; 427/151; 427/288; 428/211; 428/307; 428/411; 428/914

[58] Field of Search ..... 204/159.23, 159.24, 204/159.16; 427/54, 151; 282/27.5; 428/307, 914, 211; 106/21

[56] References Cited

U.S. PATENT DOCUMENTS

| | | | |
|---|---|---|---|
| 3,952,117 | 4/1976 | Miyamoto et al. | 427/150 |
| 4,007,310 | 2/1977 | Miyamoto et al. | 428/195 |
| 4,012,538 | 3/1977 | Miyamoto et al. | 427/145 |
| 4,073,968 | 2/1978 | Miyamoto et al. | 427/54 |

*Primary Examiner*—Richard B. Turer

*Attorney, Agent, or Firm*—Tilton, Fallon, Lungmus & Chestnut

[57] ABSTRACT

A method of desensitizing carbonless paper by subjecting N-vinyl pyrrolidone and a free radical copolymerizable compound having at least one terminal ethylenic group per molecule in situ to ultra violet radiation.

7 Claims, No Drawings

METHOD OF DESENSITIZING CARBONLESS PAPER

BACKGROUND AND SUMMARY OF INVENTION

This invention relates to a method of desensitizing carbonless paper and, more particularly, to preventing image formation in selected areas of carbonless paper. In a typical carbonless paper form, the back side of the top sheet has a coating of microscopic capsules containing colorless chromogens or color precursors in the oil. This top sheet is called CB paper, for coated back. The bottom sheet is the receiving sheet which is coated with a color developer. It is designated as CF paper, for coated front. The intermediate plies have the color developer coating on the front side and microcapsules coating on the back side. These sheets are called CFB. A self-contained paper has both the color developer and microcapsules coated on the same side of the web. The color precursor is an electron donator while the color developer is an electron acceptor.

There are three kinds of color developers commonly used in the receiving sheet of carbonless paper system: the acid clays, such as attapulgite clay, Silton clay, acid leached kaolin clay, and the like; phenolic novolac resins, such as zinc modified novolac of p-phenylphenol, p-octylphenol, p-tert-butylphenol, and the like; metal salts of organic carboxylic acids, such as zinc salts of 3,5-di-tert-butylsalicylic acid, 5-octylsalicylic acid, 4,7-diisopropyl-1-hydroxy-2-naphthoic acid, and the like.

The chromogens which react with the color developers to form images include phthalides, such as 3,3-bis (p-dimethylaminophenyl)-6-dimethylaminophthalide, 3,3-bis (p-dimethylaminophenyl) phthalide, and 3,3-bis (1-ethyl-2-methylindol-3-yl) phthalide: derivaties of Michler's hydrol, such as benzyl ether of Michler's hydrol, p-toluene sulfinate of Michler's hydrol, and morpholine derivative of Michler's hydrol; fluorans, such as 6-diethylamino-2-chloro-3-methylfluoran, 6-diethylamino-2,3-dimethylfluoran, 6-diethylamino-2-methylfluoran, 6-diethylamino-2-dibenzylaminofluoran, 6-diethylamino-2-anilino-3-metylfluoran, 2,2'-bis (6-diethylaminofluran), and 6-diethylamino-2-acetylmethylaminofluoran; and lactams, such as rhodamine-B-anilinolactam, rhodamine-B-(p-nitroanilino) lactam, and rhodamine-B-(p-chloroanilino)-lactam.

There are water base and ink base desensitizers known in the prior art. Water base compounds are much less effective for the organic acid developers such as phenolic novolac and metal salts of salicylic acid derivatives. The ink base desensitizers remain tacky for a long period of time after being applied to the web and this is particularly undesirable when the web roll is running at production speed. The ink base material tends to adhere to the back side of the web, thereby being inadequate for wholly covering a selected portion of the CF sheet. Then, when image production occurs, viz., typing or printing, unwanted images appear because a portion of the desensitizer has been carried away on the back of the web.

The purpose of this invention is to desensitize certain desired areas containing the color developer (whether CF or selfcontained) so that the image development is prevented. The desensitizers are formed in situ via free-radical induced polymerization. More particularly, the desensitizer composition is the copolymer of N-vinylpyrrolidone and ethylenically unsaturated oligomers of the following formula:

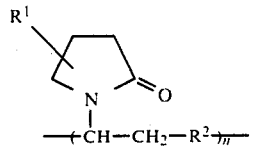

wherein $R^1$ is a hydrogen atom, or an alkyl group having from 1 to 4 atoms; $R^2$ represents a block of the ethylenically unsaturated compound, such as acrylates and vinyl compounds; and n is an integer of 1 to 10. Thus, the free-radical co-polymerizable compounds have at least one terminal ethylenic group per molecule.

As indicated above, the co-polymerizable compounds are acrylates and olefinic compounds. The preferred acrylates are monofunctional acrylates, such as methyl acrylate, methyl methacrylate, lauryl acrylate, 2-ethylhexyl acrylate; polyfunctional acrylates, such as ethylene glycol dimethacrylate, polyethylene glycol dimethacrylate, 1,6-hexanediol diacrylate, trimethylol propane trimethacrylate, trimethylol propane triacrylate, pentaerythritol triacrylate, neopentyl glycol diacrylate, and the like. Mixture of these acrylates and their oligomers may also be used. The oligomers include acrylated resin RR 27441 (Celanese Chemical Company, New York), acrylated resin RR 27418 (Celanese Chemical Company), Celrad 3699 acrylated resin (Celanese Chemical Company, CK-7623 clear UV varnish (Inmont Corporation), Acrylated Resin DRH 370 (Shell Chemical Company), Acrylated Resin SA 9928 (Sherwin-Williams Company), and Celrad Acrylated Resin 3700 (Celanese Chemical Company). The preferred olefinic compounds are acrylonitrile, isobutyl vinyl ether, vinyl acetate, vinyl laurate, vinyl stearate, styrene, biallyl, diallyl phthalate, divinyl adipate, divinyl benzene, diethylene glycol bis (allyl carbonate), butane divinyl ether, and the like.

A photoinitiator is employed to induce the polymerization upon the exposure to radiation such as ultraviolet light or electron beam. The preferred photoinitiators are chlorothioxanthone (Ultra-Cure I-100 manufactured by Sherwin Williams Company), benzoin butyl ether (Vicure 19, Stauffer Chemical Company), a mixture of alkylbenzoin ethers (Vicure 50, Stauffer Chemical Company), benzophenone, 4,4'-bis (dimethylamino) benzophenone, and azobisisobutyronitrile.

Additionally, the photoinitiation may be enhanced by the addition of synergists, such as dimethylaminoethanol, diethylaminoethanol, N-methyl diethanolamine, and N-methylmorpholine.

The following examples are intended to exemplify the actual practice of the present invention without limiting the scope of the invention.

EXAMPLE 1

Three parts of benzophenone and 1 part of Michler's ketone were dissolved in 25 parts of N-vinylpyrrolidone at the ambient temperatures. The solution was added into 75 parts of acrylated resin DRP 370 (Shell Chemical Company) and 6 parts of trimethylol propane triacrylate. The resulting solution was spot-coated on a receiving paper coated with Silton acid clay. Upon exposure to the ultraviolet light for a fraction of a second, the polymerization took place to form the desensitizing copolymer. When this receiving paper was mated with a capsule coated paper, no images could be developed in the desensitized area.

EXAMPLE 2

One gram of chlorothioxanthone was dissolved in 20 parts of N-vinylpyrrolidone. The solution was mixed into 40 parts of Celrad 3600 radiation curable resin (diacrylate ester of disphenol A type epoxy resin from Celanese Chemical Company). The resulting solution was selectively applied on the desired area of a receiving paper which has been coated with phenolic novolac resins. The coated area was exposed to the ultraviolet light to produce the polymerized desensitizer in situ. As before, no image was developed when this paper was mated with a CB sheet.

EXAMPLE 3

Six parts of benzophenone and 2 parts of diethylaminoethanol were dissolved in 20 parts of N-vinylpyrrolidone and 40 parts of trimethylol propane trimethacrylate. Twenty parts of Celanese resin RR-27418 (a medium viscosity acrylated epoxy resin from Celanese Chemical Company) were mixed into the above solution. The resulting solution was spot-coated on the receiving paper containing zinc salt of 3,5-di-tert-butylsalicylic acid. The coating was subject to ultra violet light exposure to yield the polymerized desensitizer in the coated area which prevented image development.

In general, the most effective composition employed about 10 to about 35 parts of N-vinylpyrrolidone and about 90 to about 65 parts of the free-radical co-polymerizable compounds. The amount of photoinitiator employed may be from about 1 to about 10% by weight of the above composition; preferably, from about 3 to about 8% of the combined weight of N-vinylpyrrolidone and the free-radical co-polymerizable compound. Likewise, the amount of synergist may be from about 1 to about 10%, by weight; preferably, from about 3 to about 8% by weight of the composition.

The viscosity of the mixture of N-vinylpyrrolidone, the co-polymerizable compounds and the the photoinitiator/synergist is from about 1,000 cps to about 100,000 cps; preferably between about 2,000 cps and about 80,000 cps. The preferred coat weight is from about 0.5 pounds to about 1.0 pounds per 3300 square foot ream.

The desensitizers of the present invention are very easy to formulate and convenient for printers to apply using existing printing equipment. The coating is cured virtually instantaneously upon the exposure of ultra violet light or electron beam so as to facilitate high speed, commercial production. This encourages business form manufacturers, printers, etc. to develop the carbonless papers "in line" with existing production, thereby assuring the customer of a low cost, high quality product. This provides a much more advantageous method than that of U.S. Pat. No. 4,022,624 which also deals with desensitizers. The novel approach herein of coating the solvent-free materials and producing the desensitizer in situ in one step offers operational advantages and energy savings. The process is different from that of the '624 patent.

The desensitizers disclosed in U.S. Pat. No. 4,022,624 are N-(aminoalkyl) lactam and its derivatives of epoxides, aliphatic carboxylic acids, phenols, acrylonitrile, and thiourea. These compounds are structurally different from the copolymers of the present invention and there are no polymerization reactions involved in the '624 patent.

Even further, the '624 patent teaches that poly-N-vinyl-pyrrolidone and polyacrylate are used as binders for the color developer (line 46, column 5). Therefore, it is clear that these two materials are not desensitizers per se for the color developer and, in fact, would not be considered for the purposes of this invention.

While in the foregoing specification, a detailed explanation has been set down for the purpose of acquainting those skilled in the art with the best modes known for practicing the invention, many variations may be made in the details given without departing from the spirit and scope of the invention.

I claim:

1. A method of desensitizing a carbonless paper having as a color developer thereof a member selected from the class consisting of an acid clay, a phenolic novolac resin and a metal salt of an organic carboxylic acid, comprising applying from about 10 to about 35 parts N-vinylpyrrolidone, from about 65 to about 90 parts of a free-radical co-polymerizable compound having at least one terminal ethylenic group per molecule and from about 1% to about 10% of the combined weight of said N-vinylpyrrolidone and said free-radical copolymerizable compound of a photoinitiator to selected portions of said paper and thereafter subjecting said paper to ultraviolet radiation.

2. The method of claim 1 in which said compound has the following formula

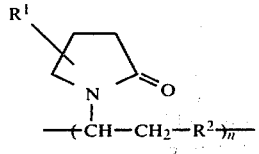

wherein $R^1$ is a hydrogen atom, or an alkyl group having from 1 to 4 carbon atoms; $R^2$ represents a block of the ethylenically unsaturated compound, n is an integer of 1 to 10.

3. The method of claim 1 in which said photoinitiator is present in an amount of about 3% to about 8%.

4. The method of claim 1 in which said photoinitiator is enhanced by the presence of a synergist in an amount of about 1% to about 10% by weight of said copolymer, said photoinitiator being a member selected from the class consisting of dimethylaminoethanol, diethylaminoethanol, N-methyl diethanolamine, and N-methylmorpholine.

5. The method of claim 1 in which the viscosity of the mixture of said N-vinylprrolidone, the co-polymerizable compound and the photoinitiator is from about 1,000 cps to about 100,000 cps.

6. The method of claim 5 in which said viscosity is in the range of about 2,000 to 80,000 cps.

7. In a method of desensitizing a carbonless paper having as a color developer thereof a member selected from the class consisting of an acid clay, a phenolic novolac resin and a metal salt of an organic carboxylic acid, the steps of applying N-vinylpyrrolidone and ethylenically unsaturated oligomers having the following formula

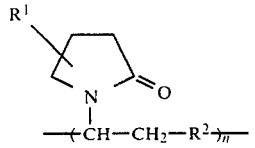

wherein $R^1$ is a hydrogen atom, or an alkyl group having from 1 to 4 carbon atoms; $R_2$ represents a block of the ethylenically unsaturated compound, n is an integer of 1 to 10, and in the presence of a photoinitiator to selected portions of a carbonless paper and thereafter subjecting said paper to ultraviolet radiation to form said N-vinylpyrrolidone and ethylenically unsaturated oligomers into a copolymer to densensitize the electronaccepting moiety of said carbonless paper, said copolymer including from about 10 to about 35 parts of N-vinylpyrrolidone and from about 90 to about 65 parts of the free-radical copolymerizable compound, said photoinitiator being present in about 1% to about 10% of the weight of said copolymer.

* * * * *